US007524085B2

(12) United States Patent
Bedson et al.

(10) Patent No.: US 7,524,085 B2
(45) Date of Patent: Apr. 28, 2009

(54) SERIES WIRING OF HIGHLY RELIABLE LIGHT SOURCES

(75) Inventors: Jon R. Bedson, Portland, OR (US); Thomas R. McNeil, Portland, OR (US); Mark D. Owen, Beaverton, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 271 days.

(21) Appl. No.: 10/577,513

(22) PCT Filed: Oct. 29, 2004

(86) PCT No.: PCT/US2004/036046

§ 371 (c)(1),
(2), (4) Date: Apr. 27, 2006

(87) PCT Pub. No.: WO2005/043954

PCT Pub. Date: May 12, 2005

(65) Prior Publication Data

US 2007/0030678 A1 Feb. 8, 2007

Related U.S. Application Data

(60) Provisional application No. 60/516,381, filed on Oct. 31, 2003.

(51) Int. Cl.
*F21V 21/00* (2006.01)

(52) U.S. Cl. ..... 362/249; 362/391; 362/800; 315/247; 315/291; 315/312; 315/185 S; 315/200 R

(58) Field of Classification Search ..... 362/249, 362/250, 252, 800, 391, 225; 313/500, 505, 313/512; 315/192, 193, 291, 294, 185 R, 315/122, 247, 312, 185 S, 200 R; 257/98, 257/99, 100

See application file for complete search history.

(56) References Cited

U.S. PATENT DOCUMENTS 3,586,959 A 6/1971 Eccles et al.

(Continued)

FOREIGN PATENT DOCUMENTS

DE 8815418 2/1989
EP 0560605 3/1993

(Continued)

OTHER PUBLICATIONS

PCT International Search Report and Written Opinion dated Jun 7, 2006 for International Application No. PCT/US04/36046, filed Oct. 29, 2004, 6 pages.

(Continued)

*Primary Examiner*—Thomas M Sember
(74) *Attorney, Agent, or Firm*—Marger Johnson & McCollom, P.C.

(57) ABSTRACT

The light array of this invention includes a number of columns and rows of LED's connected in a series/parallel combination. The series parallel combinations effectively optimize the impedance, accommodate failure rate, facilitate light mixing, provide a means of imbedding redundancy, and common cathodes or anodes. This arrangement provides a superior light source for consumer, industrial and specialty markets in respect to mean time between failure, process control, radiant intensity, wavelength mixing, power requirements and other characteristics of the light source. Each column includes a number of rows of plural LED's. The LED's in each row are wired in series and each column is wired in parallel so that if one LED fails only the LED's connected in series with the failed LED will also fail. There is redundancy in the circuit as well as the arrays so that if there are failures different current carrying elements or different series LEDS will automatically by powered on. The array may be connected in series with one or more LED arrays to form a module. Multiple modules may be connected in series with other multiple modules.

13 Claims, 4 Drawing Sheets

| | | | | |
|---|---|---|---|---|
| 3,936,686 | A | 2/1976 | Moore | |
| 4,011,575 | A | 3/1977 | Groves | |
| 4,118,873 | A | 10/1978 | Rothchild | |
| 4,435,732 | A | 3/1984 | Hyatt | |
| 4,530,040 | A | 7/1985 | Petterson | |
| 4,544,642 | A | 10/1985 | Maeda et al. | |
| 4,595,289 | A | 6/1986 | Feldman et al. | |
| 4,684,801 | A | 8/1987 | Carroll et al. | |
| 4,685,139 | A | 8/1987 | Masuda et al. | |
| 4,734,714 | A | 3/1988 | Takasu et al. | |
| 5,003,357 | A | 3/1991 | Kim et al. | |
| 5,018,853 | A | 5/1991 | Hechel et al. | |
| 5,150,623 | A | 9/1992 | Woods | |
| 5,195,102 | A | 3/1993 | McLean et al. | |
| 5,296,724 | A | 3/1994 | Ogata et al. | |
| 5,397,867 | A | 3/1995 | Demeo | |
| 5,418,384 | A | 5/1995 | Yamana et al. | |
| 5,424,544 | A | 6/1995 | Shelton et al. | |
| 5,436,710 | A | 7/1995 | Uchiyama | |
| 5,449,926 | A | 9/1995 | Holm et al. | |
| 5,479,029 | A | 12/1995 | Uchida et al. | |
| 5,490,049 | A | 2/1996 | Montalan et al. | |
| 5,522,225 | A | 6/1996 | Eskandari | |
| 5,554,849 | A | 9/1996 | Gates | |
| 5,555,038 | A | 9/1996 | Conway | |
| 5,623,510 | A | 4/1997 | Hamilton et al. | |
| 5,632,551 | A | 5/1997 | Roney et al. | |
| 5,660,461 | A | 8/1997 | Ignatius et al. | |
| 5,661,645 | A | 8/1997 | Hochstein | |
| 5,698,866 | A | 12/1997 | Doiron et al. | |
| 5,715,270 | A | 2/1998 | Zediker et al. | |
| 5,719,589 | A * | 2/1998 | Norman et al. | 345/82 |
| 5,806,965 | A | 9/1998 | Deese | |
| 5,857,767 | A | 1/1999 | Hochstein | |
| 5,877,899 | A | 3/1999 | Stern et al. | |
| 5,880,828 | A | 3/1999 | Nakamura et al. | |
| 5,892,579 | A | 4/1999 | Elyasaf et al. | |
| 5,910,706 | A | 6/1999 | Stevens et al. | |
| 5,936,353 | A | 8/1999 | Triner et al. | |
| 6,033,087 | A | 3/2000 | Shozo et al. | |
| 6,058,012 | A | 5/2000 | Cooper et al. | |
| 6,088,185 | A | 7/2000 | Ratliff et al. | |
| 6,118,383 | A | 9/2000 | Hegyi | |
| 6,141,040 | A | 10/2000 | Toh | |
| 6,155,699 | A | 12/2000 | Miller et al. | |
| 6,160,354 | A | 12/2000 | Ruvinskiy et al. | |
| 6,163,036 | A | 12/2000 | Taninaka et al. | |
| 6,200,134 | B1 | 3/2001 | Kovac et al. | |
| 6,222,207 | B1 | 4/2001 | Carter-Coman et al. | |
| 6,258,618 | B1 | 7/2001 | Lester | |
| 6,273,596 | B1 | 8/2001 | Parkyn, Jr. | |
| 6,288,497 | B1 | 9/2001 | Chang et al. | |
| 6,291,839 | B1 | 9/2001 | Lester | |
| 6,299,329 | B1 | 10/2001 | Mui et al. | |
| 6,318,886 | B1 | 11/2001 | Stopa et al. | |
| 6,319,425 | B1 | 11/2001 | Tasaki et al. | |
| 6,328,456 | B1 | 12/2001 | Mize | |
| 6,340,868 | B1 | 1/2002 | Lys et al. | |
| 6,366,017 | B1 | 4/2002 | Antoniadis et al. | |
| 6,367,950 | B1 | 4/2002 | Yamada et al. | |
| 6,375,340 | B1 | 4/2002 | Biebl et al. | |
| 6,419,384 | B1 | 7/2002 | Lewis et al. | |
| 6,420,199 | B1 | 7/2002 | Coman et al. | |
| 6,424,399 | B1 | 7/2002 | Shimada et al. | |
| 6,441,873 | B2 | 8/2002 | Young | |
| 6,445,124 | B1 | 9/2002 | Asai et al. | |
| 6,459,919 | B1 | 10/2002 | Lys et al. | |
| 6,498,355 | B1 | 12/2002 | Harrah et al. | |
| 6,525,335 | B1 | 2/2003 | Krames et al. | |
| 6,534,791 | B1 | 3/2003 | Hayashi et al. | |
| 6,536,923 | B1 | 3/2003 | Merz | |
| 6,547,249 | B2 | 4/2003 | Collins, III et al. | |
| 6,554,451 | B1 | 4/2003 | Keuper | |
| 6,561,640 | B1 | 5/2003 | Young | |
| 6,561,808 | B2 | 5/2003 | Neuberger | |
| 6,573,536 | B1 | 6/2003 | Dry | |
| 6,577,332 | B2 | 6/2003 | Osawa et al. | |
| 6,578,986 | B2 | 6/2003 | Swaris et al. | |
| 6,578,989 | B2 | 6/2003 | Osumi et al. | |
| 6,607,286 | B2 | 8/2003 | West et al. | |
| 6,630,689 | B2 | 10/2003 | Bhat et al. | |
| 6,686,581 | B2 | 2/2004 | Verhoeckx et al. | |
| 6,708,501 | B1 | 3/2004 | Ghoshal et al. | |
| 6,724,473 | B2 | 4/2004 | Leong et al. | |
| 6,796,698 | B2 | 9/2004 | Sommers et al. | |
| 6,798,152 | B2 | 9/2004 | Rooke et al. | |
| 6,800,500 | B2 | 10/2004 | Coman et al. | |
| 6,815,724 | B2 | 11/2004 | Dry | |
| 6,822,991 | B2 | 11/2004 | Collins, III et al. | |
| 6,826,059 | B2 | 11/2004 | Bockle et al. | |
| 6,831,303 | B2 | 12/2004 | Dry | |
| 6,836,081 | B2 | 12/2004 | Swanson et al. | |
| 6,857,767 | B2 | 2/2005 | Matsui et al. | |
| 6,869,635 | B2 | 3/2005 | Kobayashi | |
| 6,882,331 | B2 | 4/2005 | Wu | |
| 6,930,870 | B2 * | 8/2005 | Nobe et al. | 361/103 |
| 6,937,754 | B1 | 8/2005 | Eguchi | |
| 6,992,335 | B2 | 1/2006 | Ohkawa | |
| 6,995,348 | B2 | 2/2006 | Bradley et al. | |
| 7,009,165 | B2 | 3/2006 | Hehemann et al. | |
| 7,071,493 | B2 | 7/2006 | Owen et al. | |
| 7,102,172 | B2 | 9/2006 | Lynch et al. | |
| 7,179,670 | B2 | 2/2007 | Shelton et al. | |
| 2001/0002120 | A1 | 5/2001 | Bessendorf | |
| 2001/0030782 | A1 | 10/2001 | Trezza | |
| 2001/0046652 | A1 | 11/2001 | Ostler et al. | |
| 2002/0151941 | A1 | 10/2002 | Okawa et al. | |
| 2002/0187454 | A1 | 12/2002 | Melikechi et al. | |
| 2003/0002282 | A1 | 1/2003 | Swaris et al. | |
| 2003/0038943 | A1 | 2/2003 | Almarzouk et al. | |
| 2003/0230765 | A1 | 12/2003 | Dry | |
| 2004/0000677 | A1 | 1/2004 | Dry et al. | |
| 2004/0011457 | A1 | 1/2004 | Kobayashi et al. | |
| 2004/0026721 | A1 | 2/2004 | Dry | |
| 2004/0041521 | A1 | 3/2004 | Mandler et al. | |
| 2004/0057873 | A1 | 3/2004 | Yerazunis et al. | |
| 2004/0090794 | A1 | 5/2004 | Ollette et al. | |
| 2004/0113549 | A1 | 6/2004 | Roberts et al. | |
| 2004/0119084 | A1 | 6/2004 | Hsieh et al. | |
| 2004/0134603 | A1 | 7/2004 | Kobayashi et al. | |
| 2004/0135159 | A1 | 7/2004 | Siegel | |
| 2004/0141326 | A1 | 7/2004 | Dry | |
| 2004/0166249 | A1 | 8/2004 | Siegel | |
| 2004/0201988 | A1 | 10/2004 | Allen | |
| 2004/0206970 | A1 | 10/2004 | Martin | |
| 2004/0238111 | A1 | 12/2004 | Siegel | |
| 2005/0018424 | A1 | 1/2005 | Popovich | |
| 2005/0082673 | A1 | 4/2005 | Fujiwara et al. | |
| 2005/0087750 | A1 | 4/2005 | Braddell et al. | |
| 2005/0098299 | A1 | 5/2005 | Goodson et al. | |
| 2005/0152146 | A1 | 7/2005 | Owen | |
| 2005/0218468 | A1 | 10/2005 | Owen | |
| 2005/0230600 | A1 | 10/2005 | Olson et al. | |
| 2005/0231713 | A1 | 10/2005 | Owen et al. | |
| 2005/0253252 | A1 | 11/2005 | Owen et al. | |
| 2005/0285129 | A1 | 12/2005 | Jackson et al. | |
| 2006/0216865 | A1 | 9/2006 | Owen et al. | |
| 2007/0051964 | A1 | 3/2007 | Owen et al. | |
| 2007/0109790 | A1 | 5/2007 | Anderson et al. | |
| 2007/0154823 | A1 | 7/2007 | Marson et al. | |
| 2007/0278504 | A1 | 12/2007 | Jasmin et al. | |

FOREIGN PATENT DOCUMENTS

| | | |
|---|---|---|
| EP | 0935145 | 8/1999 |
| EP | 1158761 | 11/2001 |

| | | | |
|---|---|---|---|
| EP | 1467416 | | 10/2004 |
| EP | 1469529 | | 10/2004 |
| GB | 2224374 | | 8/1988 |
| GB | 2396331 | | 6/2004 |
| GB | 2399162 | | 9/2004 |
| JP | 59035492 | | 2/1984 |
| JP | 404204333 | | 11/1990 |
| JP | 2003268042 | | 9/2003 |
| WO | WO9716679 | | 5/1997 |
| WO | WO9854227 | | 12/1998 |
| WO | WO0037904 | | 6/2000 |
| WO | WO0102846 | | 1/2001 |
| WO | WO0206723 | | 1/2002 |
| WO | WO0213231 | | 2/2002 |
| WO | WO0226270 | | 4/2002 |
| WO | WO02086972 | A1 | 10/2002 |
| WO | WO2004009318 | | 1/2004 |
| WO | WO2004011848 | A2 | 2/2004 |
| WO | WO2004038759 | | 6/2004 |
| WO | WO2004078477 | | 9/2004 |
| WO | WO2005043598 | A2 | 5/2005 |
| WO | WO2006072071 | A2 | 7/2006 |

OTHER PUBLICATIONS

PCT International Search Report dated Nov. 29, 2003 and International Preliminary Examination Report dated Sep. 29, 2003 for International PCT Application No. PCT/US03/14625, filed May 8, 2003, 6 pages.

PCT International Search Report and Written Opinion dated Aug. 26, 2005 for International PCT Application No. PCT/US05/09407, filed Mar. 18, 2005, 11 pages.

PCT International Search Report and Written Opinion dated Jun. 17, 2005 for International PCT Application No. PCT/US04/36370, filed Nov. 1, 2004, 6 pages.

PCT International Search Report and Written Opinion dated Oct. 13, 2006 for International PCT Applicatiion No. PCT/US05/13448, filed Apr. 19, 2005, 8 pages.

PCT International Search Report and Written Opinion dated Sep. 28, 2006 for International PCT Application No. PCT/US05/11216, filed Mar. 30, 2005, 9 pages.

PCT International Search Report and Written Opinion dated Oct. 16, 2005 for International PCT Application No. PCT/US05/09076, filed Mar. 18, 2005, 10 pages.

PCT International Search Report and Written Opinion dated Feb. 6, 2007 for International PCT Application No. PCT/US05/12608, Apr. 12, 2005, 9 pages.

PCT International Search Report and Written Opinion dated Feb. 27, 2008 for International PCT Application No. PCT/US05/47605, Dec. 30, 2005, 9 pages.

Electronmagnetic spectrum (http://www.brocku.ca/earthsciies/people/gfinn/optical/spectrum.gif).

Supplemental European Search Report and written opinion for corresponding EU application No. EP03724539, dated Nov. 21, 2007, 8 pages total.

Perkowski, James; "Spacing of High-Brightness LEDs on Metal Substrate PCB's for Proper Thermal Performance," IEEE Inter Soc. Conference on Thermal Phenom, 2004.

PCT International Search Report and Written Opinion dated Jun. 3, 2005 for International PCT Application No. PCT/US04/36260, Oct. 28, 2004, 9 pages.

* cited by examiner

SERIES WIRING OF HIGHLY RELIABLE LIGHT SOURCES

This invention claims the benefit of U.S. Provisional Application No. 60/516,381, entitled "Series Wiring of Highly Reliable Light Sources," filed Oct. 31, 2003, the entire disclosure of which is hereby incorporated by reference as if set forth in its entirety for all purposes.

BACKGROUND OF THE INVENTION

Solid state lighting devices such as, for example, light emitting diodes (LED's) are used for a number of applications. One type of such solid state lighting device is disclosed in International Patent Application No. PCT/US03/14625, filed May 28, 2003, entitled High Efficiency Solid-State Light Source And Methods Of Use And Manufacture, the details of which are hereby incorporated by reference.

There are numerous applications where a long string of devices, such as, for example, LED's, need to be connected electrically. Such strings present unique problems for the electrical engineer. On the one hand, there is a desire to string the components in series so that the current from one component flows directly through the next component. This is a desired configuration because it minimizes the amount of electrical current required while increasing the total voltage required across all the components. Since high currents are more difficult to deal with because high currents require large gauge wires, for example, it is desired to have lower currents and higher voltages.

However, stringing the components together in series presents a problem because if one of the components in the string fails, it will result in the failure of the entire string. For example, in a string of holiday lights wired in series, if one light fails the entire string also fails. To overcome this problem, holiday string lights are typically wired in parallel so that when one light fails the rest of the lights in the string continue to operate. However, such wiring requires higher current and lower voltage.

Wiring lights in series is preferred because the total current is lower and the operating voltage is higher. This presents a problem because if one light fails all lights in the series fail. Wiring lights in parallel overcomes this problem because when one light fails all other lights still operate. However, one undesirable aspect of wiring in parallel is that the total current is higher and the operating voltage is lower.

One prior art approach to this problem is described in U.S. Pat. No. 6,153,980 (Marshall et al). This patent describes a circuit that has individual sensors for each light source and can determine if any given light source has failed. In the event of failure, the circuit shunts current around the failed component so that the rest of the components that are wired in series continue to receive electrical current. While such a circuit solves the problem of allowing serial connection (and, thus, higher voltage and lower current) the circuit itself is more complicated, expensive, and prone to possible failure, which defeats it's intended purpose.

What is needed is a light source that never fails or that at least has such a high reliability and mean time between failures that failure is something that effectively can never happen. Thus, the preferred solution changes from parallel wiring to series wiring forming a cascading series parallel circuit substantially reducing failures and mean time between failures. The parallel/series circuitry enables the selection of current and potentials that can accommodate the specific performance of solid state light sources in addition to complying with industry standards for different markets. These markets can be, but are not limited to industrial (high power), consumer (low power) and specialty markets as in the case of aerospace and medical markets.

SUMMARY OF THE INVENTION

The present invention provides a light source that is composed of an array of devices having a very large mean lifetime. The array is wired in a combination series and parallel circuit that ensures that the composite device will virtually never burn out. The light sources in the array of this invention are wired together in series without concern of the consequences of a module failure.

The array of this invention may include a composite of LED's that may number in the hundreds or about one thousand, for example. LED's are solid-state light sources with very long lifetimes that are measured in hundreds of thousands of hours. The array of this invention capitalizes on the lifetime of the LED's but also capitalizes on their low operating current and voltage to produce a composite array that is partly parallel and partly in series.

The light array of this invention includes a number of columns and rows of LED's. Each column includes a number of rows of plural LED's. The LED's in each row are wired in series and each column is wired in parallel so that if one LED fails only the LED's connected in series with the failed LED will also fail. The array may be connected in series with one or more LED arrays.

Another advantage of the present invention is that connecting the LED's in series provides all of the LED's in the series with the same amount of current so that the LED's have the same brightness.

This invention provides a lighting module comprising an array of LED's consisting of plural columns and rows, wherein each row of LED's in each column is connected in series and each column is connected in parallel. The LED array may be connected in series to one or more LED arrays. Each column in the LED array may contain at least one row of, for example, three LED's. Each column in the LED array may contain, for example, twenty-five rows of LED's. The LED array may contain, for example, thirteen columns.

This invention also provides novel circuits for driving LED's. In one embodiment, a circuit is provided that results in a high LED peak intensity without requiring more power input. In another embodiment, a circuit is provided for pulsing an array of LED's that results in very high current levels in the LED's without causing over-dissipation.

These and other embodiments are described in more detail in the following detailed descriptions and the figures. The foregoing is not intended to be an exhaustive list of embodiments and features of the present invention. Persons skilled in the art are capable of appreciating other embodiments and features from the following detailed description in conjunction with the drawings.

DETAILED DESCRIPTION OF THE INVENTION

Figure 1:
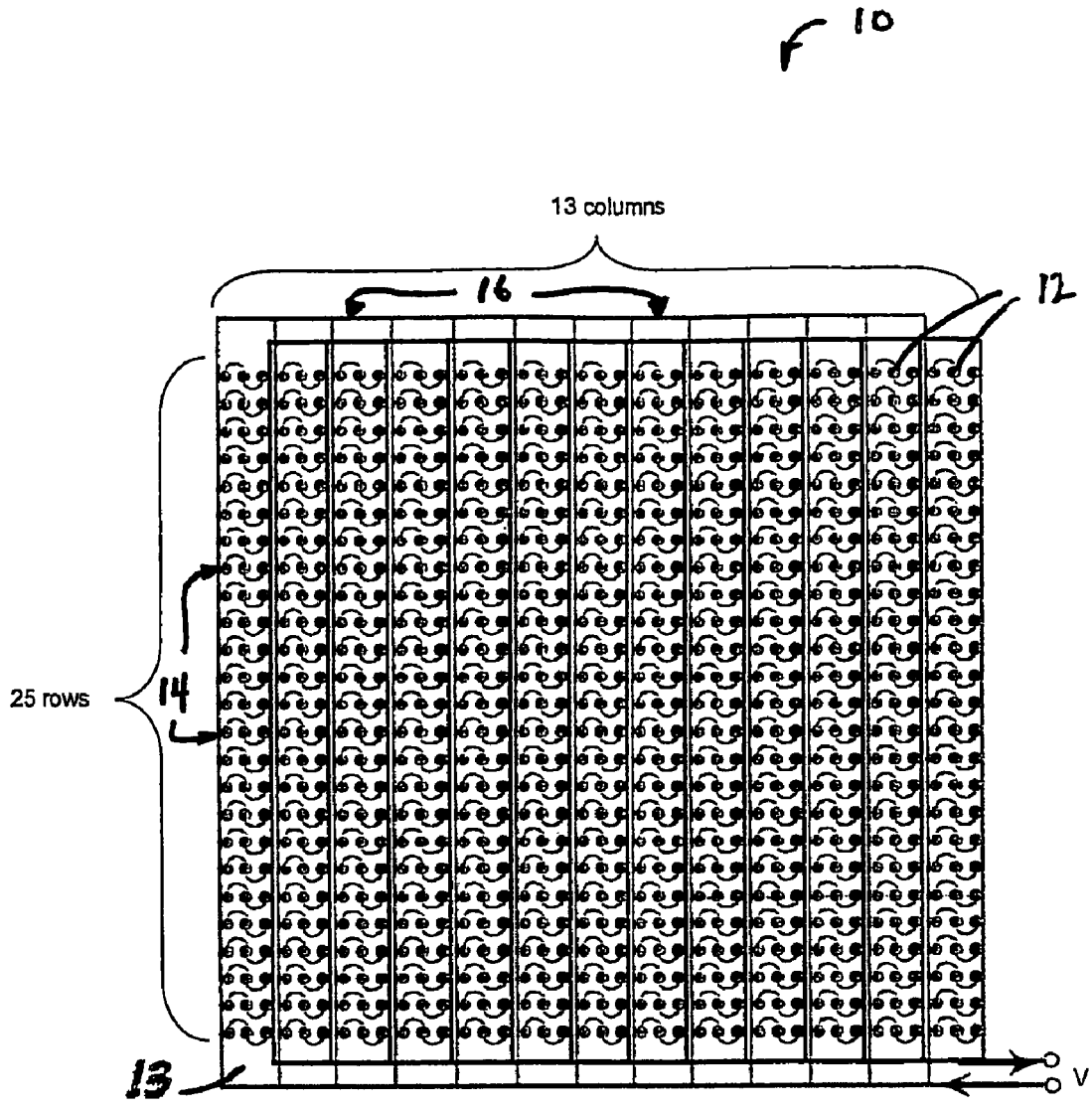
FIG. 1 shows an array of LED's that are wired both in series and in parallel.

Representative embodiments of the present invention are shown in FIG. 1, wherein similar features share common reference numerals.

As shown in FIG. 1, an LED array 10 is shown that is wired in a series/parallel combination. The LED array 10 includes a plurality of individual LED's 12 mounted on a substrate 13 and arranged in rows 14 and columns 16. Each column 16 includes plural rows 14 of LED's 12 with, for example, three LED's 12 in each row 14. There may be, for example, twenty-five rows 14 in each column 16. The LED's 12 in each row 14 are wired in series and each column 16 is wired in parallel. Since the LED's 12 in each row 14 are wired in series it is ensured that if one LED 12 fails only the other LED's 12 in that series will fail also. The loss the LED's 12 in a single row 14 in the total array 10 has only a minimal impact on the total brightness of the array 10 since it consists of many LED's 12.

In this example, the total voltage required to drive the LED array 10 is roughly three times the forward voltage drop across any given LED 12. The total current required to drive the LED array 10 is 13·25·XmA, where 13 is the number of columns 16 for each array 10, 25 is the number of rows 14 of LED's 12, and Xma is the nominal drive current required for each LED 12. For example, the LED 12 might have a nominal forward current of 20 mA at a forward voltage of between 3.6 and 4.0 volts. For example, the voltage and current for driving a single board populated with these LED's 12 may be 13·25·0.020A=6.5A and between 10.8-12 volts.

If all of the LED's 12 were wired in parallel, the required current would be three times higher, and the voltage three times lower. The configuration of FIG. 1 provides an improvement in offering considerably lower current at higher voltage while at the same time producing an LED array 10 that has a virtually unlimited lifetime.

Figure 2:
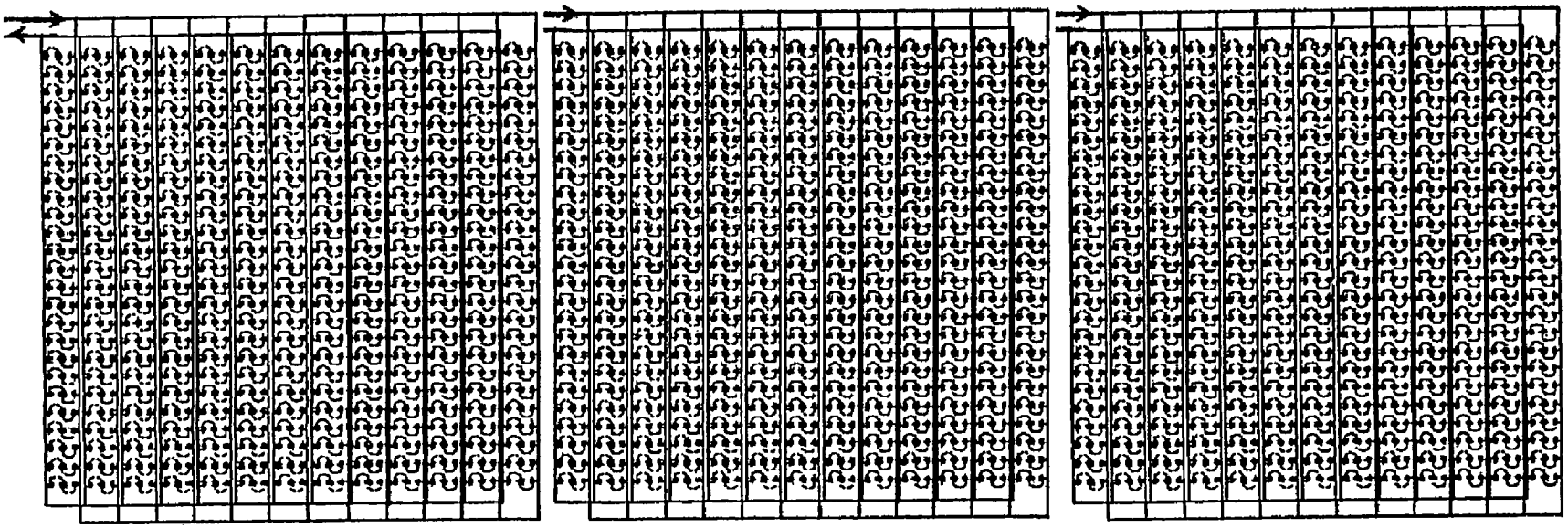
FIG. 2 shows a module of plural arrays of LED's wired together.

Each LED array 10 may be wired, preferably, in series to one or more other LED arrays to form a module as seen in FIG. 2. Multiple modules may be wired, preferably, in series to other multiple modules. However, because of the virtually unlimited lifetime of the LED array 10 the modules may be wired in parallel or in series without regard for concerns that one of the LED arrays might fail causing failure of the whole module.

For example, one might want ten LED arrays 10. Wiring them in series requires (using the numbers from the above example) 6.5 amps at about 120 volts. This is roughly the electrical requirement of a domestic vacuum cleaner. By comparison, if the ten LED arrays were operated in parallel they would require 65 amps at about 12 volts, which is roughly the requirements of a light-duty arc welder. So, when wired in series the electrical requirements are far more tractable than when wired in parallel.

Thus, wiring in series results in lower current and higher voltage requirements. These requirements are more easily (cheaply and inexpensively) met by power supplies than having to provide higher current and lower voltage. However, as discussed above, series connections result in the entire string failing when any single component fails. This is such a significant disadvantage that in almost all cases the wiring is done in parallel and the consequent cost in high current and low voltage is simply absorbed by the consumer.

With the LED array of this invention, a light source is provided that is made of distributed devices having lifetimes of hundreds of thousands of hours. The array 10 itself is wired in a parallel/series combination that ensures that if one LED 12 fails, at most only two others fail with it, as shown in this example. This is a minor problem for an array with hundreds of LED's 12. Except for row 14 of LED's 12 wired in series, the columns 16 of LED's are wired in parallel, ensuring that the LED array 10 can virtually never fail. It is this extreme reliability that allows multiple LED arrays 10 to be strung together in series without regard for failure in any given array.

The number of rows 14, columns 16, and number of LED's 12 in each row 14 may vary depending on a number of factors such as, for example, the size of the array substrate.

Figure 3:
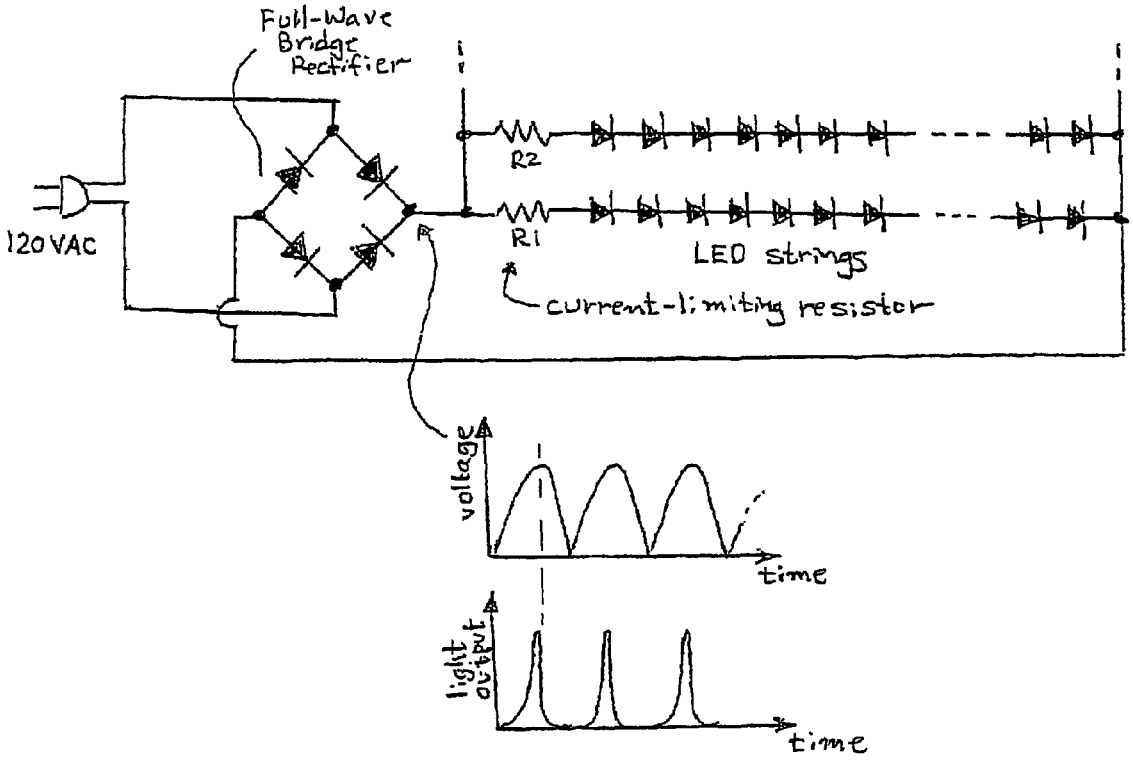
FIG. 3 shows a full-wave bridge rectifier for directly driving a single string of LED's of FIGS. 1 and 2.

FIG. 3 shows a full-wave bridge rectifier for directly driving a single string of LED's as shown in FIGS. 1 and 2. A resistor may be used to provide a limit on current. One novel feature of this circuit is that no filter capacitor is used. The LED string conducts only on the peaks of the pulsating-DC output of the rectifier. The LED current may be high, which may have an operational advantage in high peak light output, particularly for chemical processes. However, the duty cycle is limited. The result is a high LED peak intensity for the same power input. It is known that the human eye responds to the peak intensity of a light source. The scheme of FIG. 3 results in a visible light source of higher apparent brightness for a given power dissipation.

Figure 4:
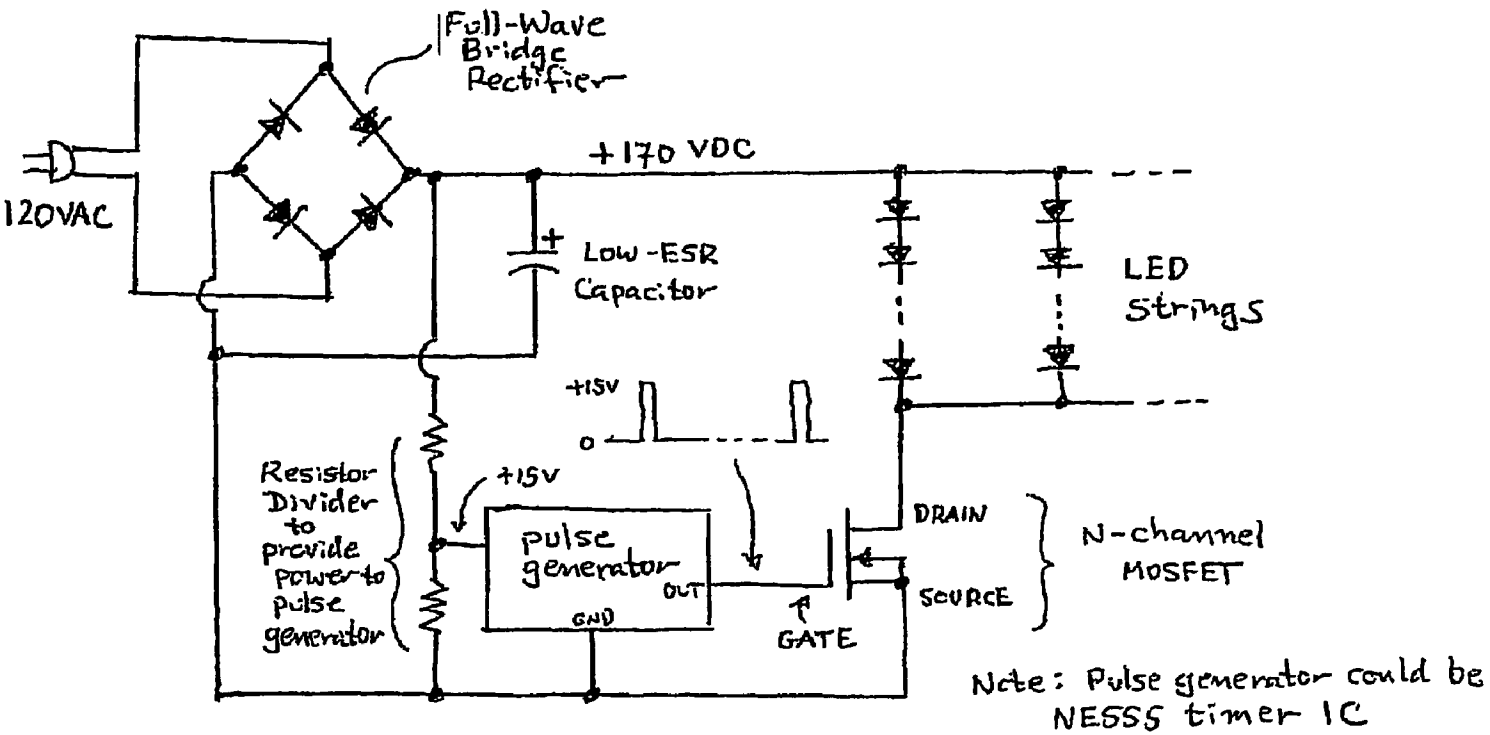
FIG. 4 shows a circuit for pulsing an array of LED's as shown in FIGS. 1 and 2.

FIG. 4 shows a novel scheme for pulsing an array of LED's as shown in FIGS. 1 and 2. In this scheme, an AC-DC supply (shown here as an off-line rectifier) is used to charge a low-ESR (equivalent series resistance) capacitor to a voltage much higher than the low-current operating voltage of the LED. A string of LED's is placed in series with a high-current MOSFET switch across this capacitor. If the MOSFET is switched to "ON" at a duty cycle equal to or lower than 5%, it is possible to create very high current levels in the LED's without causing over dissipation. Since the LED output is proportional to current in the LED, the resulting peak optical output of the LED is many times its DC value. This can have advantages both in visible and chemical systems applications.

An LED can be electrically modeled as a diode with a series resistance. Pulsing the LED in the manner described overcomes the series resistance and allows the current in the LED to be determined by the usual diode equation:

$$I = \mathrm{Is}\ exp\ (V/kt),$$

where I is the current in the LED, Is is the saturation current, V is the voltage applied across the diode junction (not the LED), k is the Boltzman constant, and t is the absolute temperature.

It can be shown that very high currents are possible in an LED junction if the series resistance can be overcome by high-voltage pulsing means. Voltages across individual LED's can be in excess of 20 volts for a 3-volt junction voltage. The actual construction of the individual LED will determine how high the applied voltage can be before voltage breakdown occurs. As such, voltages considerably higher than a typical 3.3 volts may be applied to drive the LED's. Individual LED's may be pulsed with voltages of between 6-50 volts. However, voltages up to 150 volts may be applied to the LED's. It is also possible with this invention to pulse at least one LED up to 1,000 times its DC current value.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed:

1. A lighting device, comprising:

an array of LEDs consisting of plural columns and rows, wherein each row of LEDs in each column is connected in series and each column is connected in parallel;

a low equivalent series resistance capacitor electrically connected to the array of LEDs; and a metal-oxide semiconductor field-effect transistor (MOSFET) electrically connected in series with the array of LEDs, the MOSFET arranged to act as a switch to the capacitor.

2. The lighting device of claim 1, wherein the LED array is connected in series to one or more LED arrays to form a module.

3. The lighting device of claim 1, wherein each column in the LED array contains at least one row of one or more LED's.

4. The lighting device of claim 3, wherein each column in the LED array contains at least two or more rows of LED's.

5. The lighting device of claim 4, wherein the LED array contains at least two or more columns.

6. The lighting device of claim 1, wherein the LED's connected in series are supplied with the same amount of current so that each LED emits the same brightness.

7. The lighting device of claim 1, wherein each of the two or more LED's in each column is also supplied with the same amount of current so that each column emits the same brightness.

8. The lighting device 3, wherein each module is connected in series to one or more modules.

9. The lighting device 3, wherein each module is connected in parallel to one or more modules.

10. A method of operating a lighting device, comprising:

charging a capacitor to a voltage at least three times higher than an operating voltage of an LED using an input DC power level;

periodically switching on a metal oxide semiconductor field effect transistor (MOSFET) to create a current in the LED; and generating a peak optical output int he LED, the peak optical output being a multiple of the DC power level and is generated while the MOSFET is on.

11. The method of claim 10, wherein the charging further comprises using a full-wave bridge rectifier circuit.

12. The method of claim 10, wherein charging a capacitor comprises charging a low-ESR capacitor to a voltage that is substantially higher than the low-current operating voltage of the LED.

13. The method of claim 12, wherein periodically switching on a MOSFET comprises switching on a MOSFET placed in series with the LED.

* * * * *

UNITED STATES PATENT AND TRADEMARK OFFICE

CERTIFICATE OF CORRECTION

PATENT NO. : 7,524,085 B2
APPLICATION NO. : 10/577513
DATED : April 28, 2009
INVENTOR(S) : Jon R. Bedson et al.

It is certified that error appears in the above-identified patent and that said Letters Patent is hereby corrected as shown below:

Column 6, line 13, the words "int he" should read -- in the --.

Signed and Sealed this

Twenty-seventh Day of October, 2009

David J. Kappos

David J. Kappos
*Director of the United States Patent and Trademark Office*